US005974805A

United States Patent [19]

Allen

[11] Patent Number: 5,974,805

[45] Date of Patent: Nov. 2, 1999

[54] HEAT SHIELDING FOR A TURBINE COMBUSTOR

[75] Inventor: John G Allen, Bristol, United Kingdom

[73] Assignee: Rolls-Royce plc, London, United Kingdom

[21] Appl. No.: 08/959,117

[22] Filed: Oct. 28, 1997

[51] Int. Cl.[6] ..... F23R 3/00; F02C 1/00

[52] U.S. Cl. ..... 60/740; 60/752; 60/756

[58] Field of Search ..... 60/39.32, 752, 60/755, 756, 740

[56] References Cited

U.S. PATENT DOCUMENTS

| | | | |
|---|---|---|---|
| 2,907,171 | 10/1959 | Lysholm | 60/756 |
| 3,656,297 | 4/1972 | Monk | 60/755 |
| 4,766,722 | 8/1988 | Bayle-Laboure et al. | 60/752 |
| 4,870,818 | 10/1989 | Suliga | 60/756 |
| 4,914,918 | 4/1990 | Sullivan | 60/756 |
| 4,999,996 | 3/1991 | Duchene et al. | 60/39.32 |
| 5,419,115 | 5/1995 | Butler et al. | 60/756 |
| 5,581,999 | 12/1996 | Johnson | 60/756 |

FOREIGN PATENT DOCUMENTS 723413 2/1955 United Kingdom .

*Primary Examiner*—Ted Kim

*Attorney, Agent, or Firm*—W. Warren Taltavull; Farkas & Manelli, PLLC

[57] ABSTRACT

A combustor for a gas turbine engine has a fuel nozzle located in the upstream end thereof and is positioned within a cylinder coaxial with said nozzle. The cylinder comprises at its downstream end an annular flange extending from the cylinder in a generally radial direction. The flange has a plurality of cooling air apertures radially extending therethrough so as to direct cooling air along the face of an adjacent heatshield.

7 Claims, 2 Drawing Sheets

HEAT SHIELDING FOR A TURBINE COMBUSTOR

THE FIELD OF THE INVENTION

This invention relates to a gas turbine engine combustor and is particularly concerned with the thermal protection of the combustor wall or bulkhead by heatshields and specifically the miniflare associated therewith.

BACKGROUND OF THE INVENTION

Modern gas turbine annular combustors are usually provided with a combustor which is of generally annular configuration. Usually a wall or bulkhead is provided at the upstream end of the combustor which is suitably apertured to receive a number of fuel burners. The fuel burners are equally spaced around the combustor and direct fuel into the combustor to support combustion therein. The combustor bulkhead is therefore usually close to the high temperature combustion process taking place within the combustor making it vulnerable to heat damage.

One way of protecting the bulkhead from the direct effects of the combustion process is to position heat shields on its vulnerable parts. Typically each heat shield is associated with a corresponding fuel burner and extends both radially towards the radially inner and outer extents of the bulkhead and circumferentially to abut adjacent heat shields. Each heat shield is spaced apart from the bulkhead so that a narrow space is defined between them. Cooling air is directed into this space in order to provide cooling of the heat shield an so maintain the heat shield and the bulkhead at acceptably low temperatures.

More recently cylinders comprising end flanges, commonly known as miniflares, have been used to direct a film of cooling air across the heatshield thus protecting it from hot combustion gases. However, although present miniflares provide a film of cooling air for the heat shield their own cooling is insufficient to prevent overheating, in particular towards its outer edge. Additionally the cooling film produced often ceases to be effective at the outer regions of the heatshield. It is an aim of the present invention, therefore, to provide an improved device for cooling a heatshield which attempts to alleviate the aforementioned problems.

SUMMARY OF THE INVENTION

According to the present invention there is provided a combustor for a gas turbine engine in which a fuel nozzle is located in the upstream end thereof and is positioned within a hollow, annular cylinder ,said cylinder comprising at its downstream end an annular flange extending from said cylinder in a generally radial direction and said flange comprising a plurality of apertures extending therethrough.

Advantageously cooling air is directed through the apertures in the annular flange thus increasing the outer edge of the cylinder and also provides an effective cooling air film across an adjacent heatshield.

BRIEF DESCRIPTION OF THE DRAWINGS

The present invention will now be described, by way of example, with reference to the accompanying drawings in which.

DETAILED DESCRIPTION OF THE INVENTION

Figure 1:
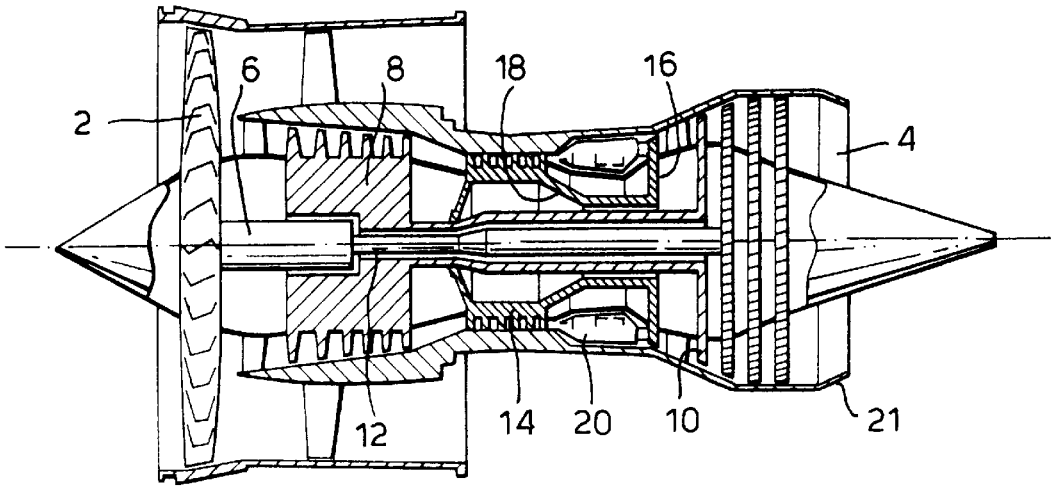
FIG. 1 is a schematic diagram of a ducted fan gas turbine engine having an annular combustor.
Figure 3:
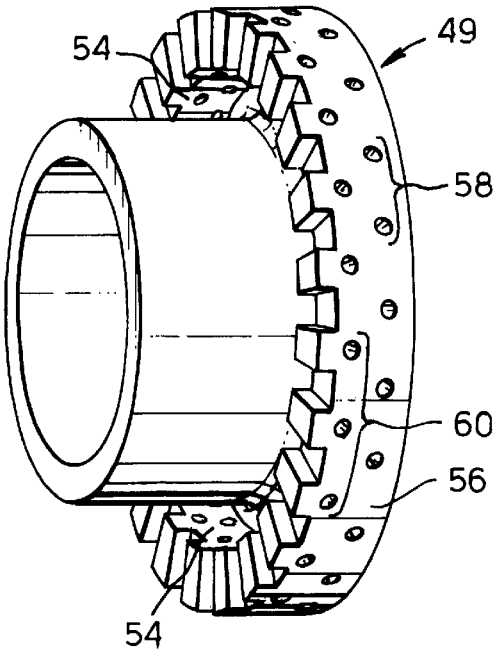
FIG. 3 is view of a cylinder and flange in accordance with the present invention.
Figure 4:
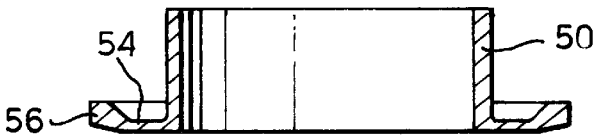
FIG. 4 is a cross sectional view of a portion of the cylinder and flange (apertures not shown) of FIG. 3.

With reference to FIG. 1 there is shown a three shafted ducted fan gas turbine engine of generally conventional configuration. It will be understood however that the present invention may be usefully employed in other engine configurations.

The engine of FIG. 1 comprises in axial flow series a low pressure spool consisting of a fan 2 driven by a low pressure turbine 4 via a first shaft 6, an intermediate pressure turbine 10 through a second shaft 12 and a high pressure compressor 14 driven by a high pressure turbine 16 via a third shaft 18, an annular combustor 20 and a propulsive nozzle 21.

Figure 2:
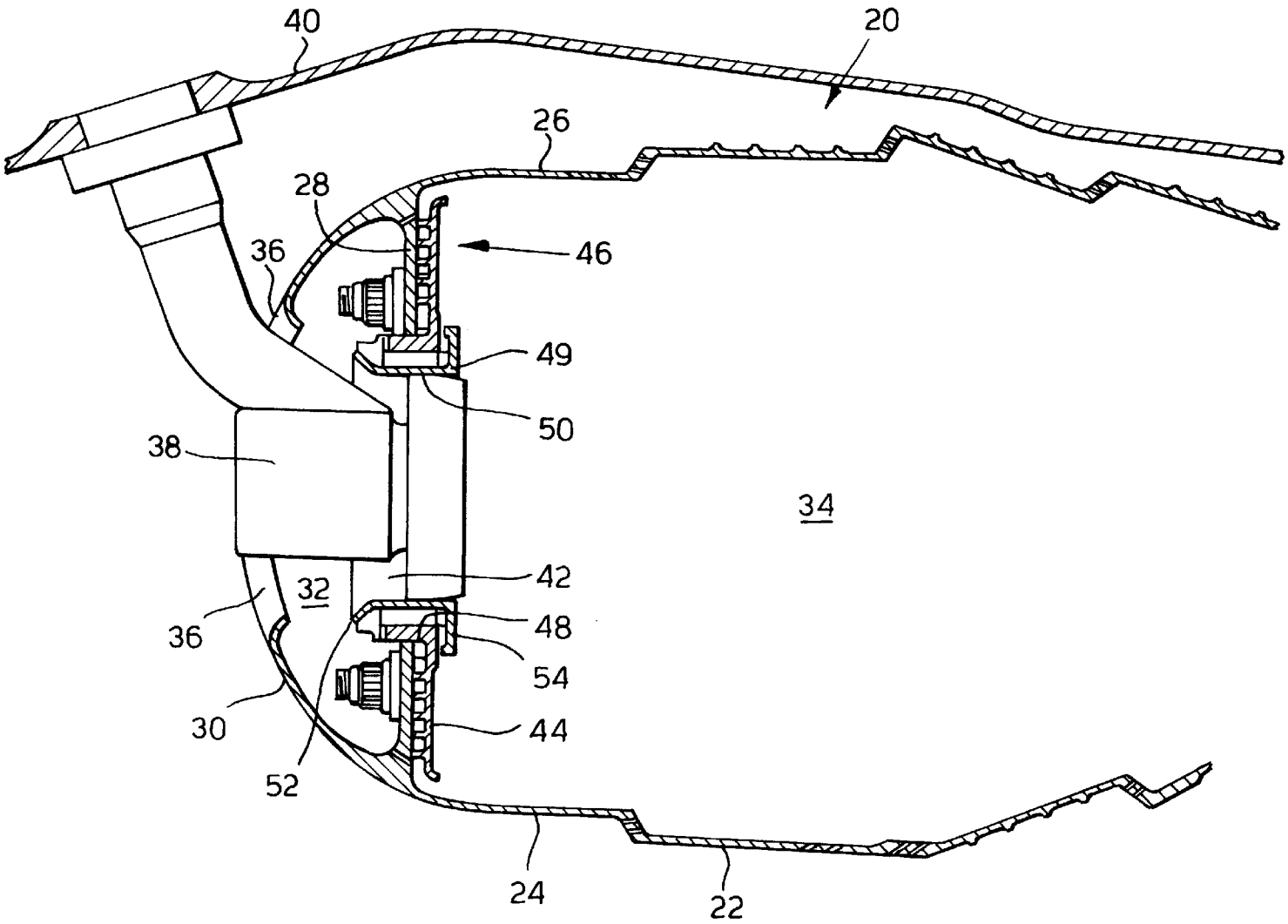
FIG. 2 is a partially sectioned side view of a combustor in accordance with the present invention.

The annular combustor 20 is shown in more detail in FIG. 2. The combustor chamber inner casing 22 comprises radially spaced inner and outer walls 24, 26 respectively, interconnected at their upstream ends by means of an annular bulkhead 28. The walls 24 and 26 extend upstream of the bulkhead to form a domed combustor head 30. The bulkhead divides the combustor into an upstream cooling air chamber 32 and a downstream combustion region.

Compressor delivery air from an upstream compressor (not shown in FIG. 2, but situated to the left of the drawing) enters the cooling air chamber 32 through a plurality of circumferentially spaced inlet apertures 36 before entering the combustion chamber 34. Fuel is delivered to the combustion chamber by means of a plurality of air spray type fuel supply nozzles 38. The nozzles are suspended from a combustion chamber outer casing structure 40 and extend into the combustor 20 through a corresponding array of circumferentially spaced apertures 42 is provided in the bulkhead member 28, each to receive the outlet of an adjacent one of the nozzles.

A protective heatshield 44 is mounted on the downstream face of the bulkhead 28 to provide thermal shielding from combustion temperatures. This heatshield has an annular configuration made up of a plurality of abutting heatshield segments 46. The segments, which are of substantially identical form, extend both radially towards the inner and outer walls 24, 26 of the combustor and circumferentially towards adjacent segments to define a fully annular shield. Some or all of the heatshield segments may be adapted to receive a fuel nozzle. Those which receive a fuel nozzle comprise an aperture the periphery of which is defined by an axially extending cylindrical flange 48 which locates the heatshield in the corresponding aperture 42 in the bulkhead wall 28.

Each heatshield segment receives an airspray burner and a miniflare seal 49. The miniflare seal 49 is in the form of an annular cylinder 50 and is provided with a pair of axially spaced radial flanges 52 and 54 which slidably engage with the heatshield flange extremities. The cylindrical miniflare 49 has an external diameter which is less than the heatshield aperture. The miniflare radial flange 54 extends radially from the downstream end of the cylinder. This flange 54 comprises a further axially extending end flange portion 56. This axially extending flange portion comprises two rows of holes 58, 60 axially spaced from one another. The upstream outer rim of this end flange portion 56 is provided with castellations 62 at its outer edge.

In use air passes through the annular gap between the miniflare 49 and the heatshield 44 into a chamber. The air then discharges through the two rows 58 and 60 of holes to produce a cooling film across the heatshield 44 or head of the chamber. Also air passing through the holes will remove heat from the edge of the miniflare 49. The provision of multi rows of holes 58, 60 in the miniflare flange end portion 56 increases the cooling of the outer edge of the miniflare and as such reduces its surface temperature and provides a more effective air film across the heatshield 44 or combustor head face thus increasing the protection from hot combustion gases.

I claim:

1. A combustor for a gas turbine engine having an upstream end in which a fuel nozzle is located, said fuel nozzle having an axis and being positioned within an annular cylinder which is coaxial with said fuel nozzle, said cylinder having a downstream end and comprising at its downstream end an annular flange extending from said cylinder in a generally radial direction and said flange having an axially extending thickness, a rear face and a front face spaced apart by said axially extending thickness to define an inner surface portion and an outer surface portion, said rear face being crenellated and a plurality of cooling fluid apertures extending through said flange between said front and rear faces thereof in a radial direction relative to said axis of said nozzle so that fluid flow of cooling air will pass through said cooling fluid apertures from said inner surface portion radially outwardly passing said outer surface portion of said flange.

2. A combustor according to claim 1 wherein said apertures are are provided in two axially spaced rows within said flange.

3. A combustor according to claim 1 wherein said cylinder also comprises a second flange positioned axially upstream from said flange of claim 1.

4. A combustor according to claim 1 wherein a heatshield is provided within an aperture for receiving said fuel nozzle.

5. A combustor according to claim 4 wherein said heatshield aperture comprises an axially extending cylindrical flange which locates the heatshield in a corresponding aperture in an upstream wall of the combustor.

6. A combustor according to claim 5 wherein the heatshield flange is provided with slots to direct cooling fluid to a region between the heatshield flange and the cylinder.

7. A combustor according to claim 6 wherein said cooling air is directed radially by said cylinder and associated flange as a film of air across the heatshield.

* * * * *